United States Patent [19]

Engel

[11] Patent Number: 4,831,810

[45] Date of Patent: May 23, 1989

[54] DEVICE FOR INSERTING PICTURE SLIDES INTO STORAGE POCKETS

[75] Inventor: Elton D. Engel, Livonia, Mich.

[73] Assignee: Creative Endeavors, Inc., Livonia, Mich.

[21] Appl. No.: 170,537

[22] Filed: Mar. 21, 1988

Related U.S. Application Data

[63] Continuation-in-part of Ser. No. 066,857, Jun. 25, 1987, abandoned.

[51] Int. Cl.[4] ..... B65B 67/04

[52] U.S. Cl. ..... 53/390; 53/258

[58] Field of Search ..... 53/390, 393, 266 A, 53/266 R, 520, 381 R, 384, 387, 255, 258, 260

[56] References Cited

U.S. PATENT DOCUMENTS

| | | | |
|---|---|---|---|
| 2,892,295 | 6/1959 | McArthur | 53/520 |
| 3,429,101 | 2/1969 | Anderson et al. | 53/520 X |
| 3,896,603 | 7/1975 | Tout | 53/520 |
| 4,135,343 | 1/1979 | Urban et al. | 53/520 X |
| 4,237,678 | 12/1980 | Thompson | 53/266 A X |
| 4,528,795 | 7/1985 | temmer et al. | 53/390 X |

*Primary Examiner*—James F. Coan

*Attorney, Agent, or Firm*—George L. Boller

[57] ABSTRACT

A device for inserting picture slides into storage pockets comprises a magazine for a stack of slides and a pusher having a blade which passes through an entrance slot at the bottom of the magazine to engage the lowest slide in the magazine and push it through an exit slot at the opposite side of the magazine and into a storage pocket with which a tongue which projects forwardly of the magazine has been inserted. The device makes it possible to quickly insert picture slides into storage pockets.

25 Claims, 7 Drawing Sheets

DEVICE FOR INSERTING PICTURE SLIDES INTO STORAGE POCKETS

REFERENCE TO A RELATED APPLICATION

This application is a continuation-in-part of my copending allowed application Ser. No. 07/066,857 filed June 25, 1987, and now abandoned.

BACKGROUND AND OF THE INVENTION

This invention relates to a device for inserting photographic transparencies, i.e. picture slides, into storage pockets.

A popular photographic medium is a film transparency, 35 mm slide being a common example. After processing, the individual exposures are mounted within two inch by two inch perimeter frames which have a thickness between 0.048 and 0.060 inch. For viewing, the slides are displayed by means of a viewer or projector.

When the transparencies are not in use, the typical practice is to store them in such a manner that they can be quickly identified, removed from storage for use, and then returned to storage after use. One common type of storage device is a binder-mounted page containing multiple storage pockets. The typical page comprises twenty pockets arranged in a four by five pattern. The individual pockets are rectangular shaped, slightly larger than the rectangular shape of the standard mounted film transparency. Each pocket is open along one edge, typically, but not restricted to, the top edge, to form the pocket's opening via which a transparency is inserted into and removed from the pocket. The typical storage page is a synthetic material such as a softer, pliable plastic. Preferably, it has a certain degree of transparency to enable an individual to see the mounted film transparencies in its pockets.

Insofar as the applicant is aware, mounted film transparencies have always been stored in and removed from the storage pockets by hand. The manner of removing the slides from the storage pockets involves a person using his or her thumb and finger to grip the border of the slide's frame which is at a pocket opening and pull the slide out of the pocket. The task of inserting a slide back into a pocket is somewhat more time consuming because the pocket opening must typically be flexed slightly and the edges of the slide's frame must be accurately aligned with the sides of the pocket before the slide can be reinserted into the pocket. One would give little heed to the task of storing a small number of slides in pockets, but storing a large number of transparencies in pockets is a time-consuming task. In commercial use, where a project involves large numbers of slides, a lot of time is spent on returning the slides to storage.

The present invention relates to a device for inserting picture slides into storage pockets, and as such it is intended to enable a large number of slides to be quickly inserted into storage pockets. In this way, the time-consuming task of inserting a large number of slides by hand into the storage pockets can be eliminated.

Further aspects of the invention within the generic context, relate to the organization and arrangement of the various parts of the device, particularly in the manner in which slides to be stored are loaded into the device and the manner in which an individual slide is discharge from the device into a storage pocket. The device has an efficient and advantageous organization and arrangement of individual component parts.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
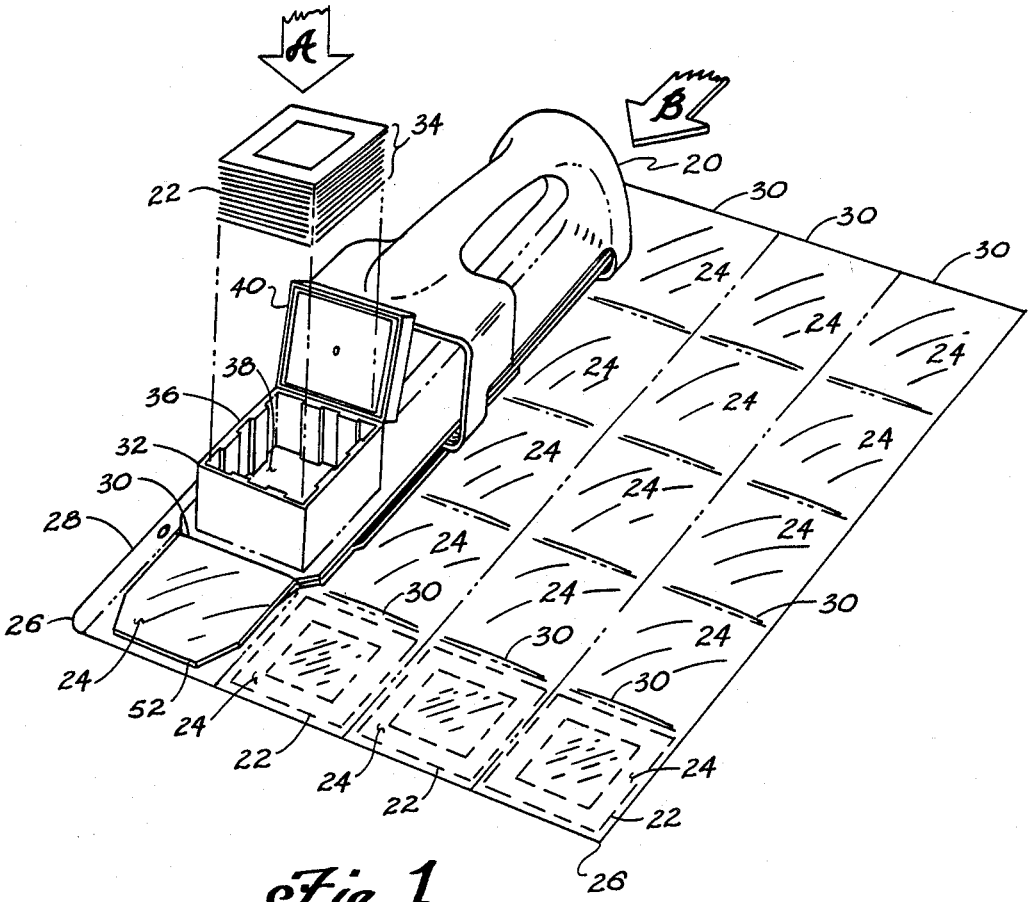
FIG. 1 is an exploded perspective view illustrating representative usage of a device according to principles of the present invention.
Figure 12:
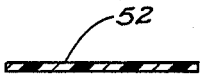
FIG. 12 is a sectional view taken in the direction of arrows 12—12 in FIG. 4A.

FIG. 1 illustrates a device 20 according to the present invention in use inserting slides 22 into pockets 24. The pockets 24 are substantially identical and arranged in a four x five array on a generally rectangular storage page 26. Along one of the longer sides is a perforated margin 28 via which the page can mount in a conventional ring binder.

The individual pockets 24 are of rectangular shape slightly larger than the rectangular shape of the slides 22. Each pocket 24 is closed along three sides. The remaining side of the pocket is left open to form the pocket opening 30. It is via this opening 30 that each slide is inserted into and removed from the pocket.

Further details of device 20 are shown in the remaining drawing figures. The specific device 20 which is to be described is designed for standard mount 35 mm slides. Certain adaptations to the illustrated device will be required for other slides, such as glass mount, but generic principles of the invention may be retained.

The device 20 comprises a magazine 32 into which a stack 34 of slides 22 is placed. Magazine 32 has a generally rectangular sidewall 36 whose interior dimensions are just slightly larger than the two inch x two inch size of the individual slides so that the stack 34 fits closely inside the magazine. The stack is supported on a platform 38 at the bottom of sidewall 36. A cover 40 is hingedly mounted at 41 along the top edge of the rear portion of the sidewall for opening and closing the open top of the sidewall. FIG. 1 shows the cover in the open position enabling the stack of slides to be inserted into the magazine. The open position is also shown in phantom in FIG. 9.

FIGS. 9, 9A, 10 and 10A show the cover in the closed position. In the closed position the cover is secured releasably latched by an integral, releasable catch mechanism 42, a portion of which is formed in the top edge of the front portion of the sidewall and a complementary portion of which is formed in the lower front edge of the cover. A spring-loaded plunger 43 is centrally mounted in the top wall of the cover. The spring-loaded plunger serves to exert a downward force on the stack 34 in the manner shown in FIGS. 9, 9A, 10 and 10A. This force is light and does not restrict the action of the device in inserting a slide into a storage pocket.

Figure 9:
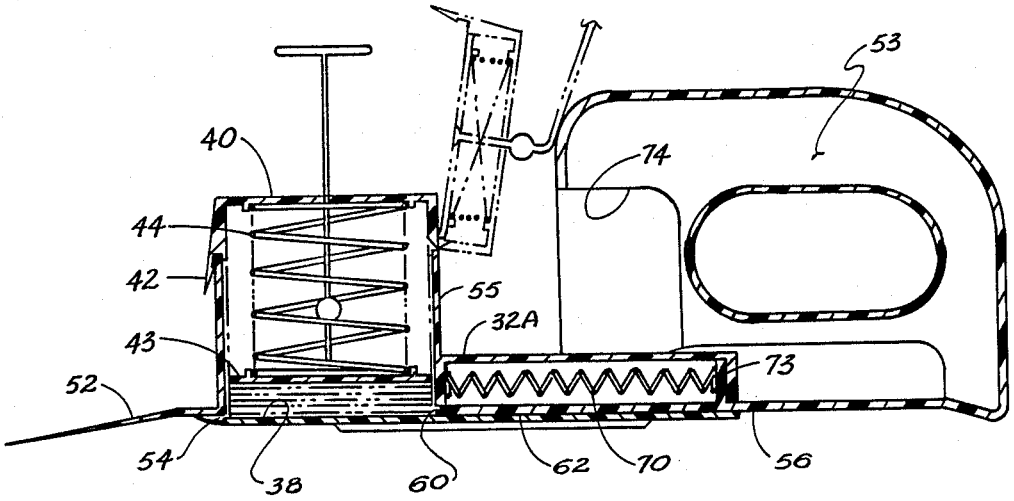
FIG. 9 is a sectional elevational view taken in the direction of arrows 9—9 in FIG. 4A.
Figure 10:
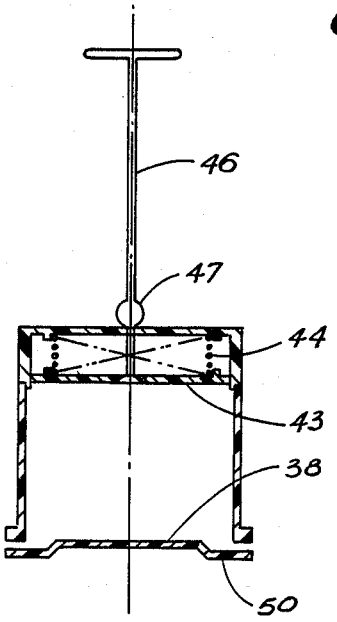
FIG. 10 is a sectional elevational view taken in the direction of arrows 10—10 in FIG. 3.
Figure 10A:
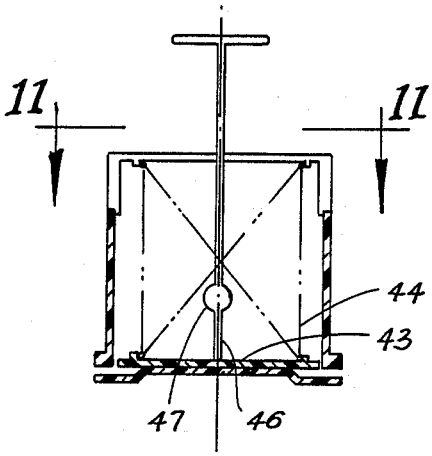
FIG. 10A is a view like FIG. 10, but illustrating an alternate position.
Figure 11:
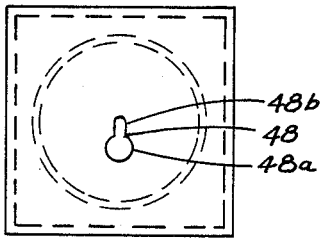
FIG. 11 is a plan sectional view taken in the direction of arrows 11—11 in FIG. 10A.
Figure 13:
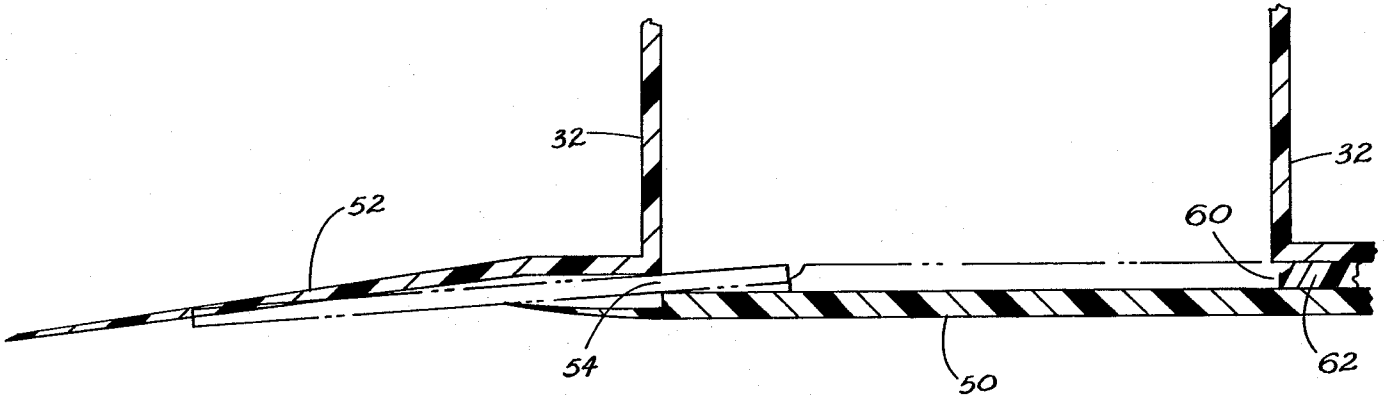
FIG. 13 is an enlarged view of a portion of FIG. 9 for illustrating further detail.

FIG. 10 shows the fully retracted position of the plunger where the spring 44 is maximally compressed. The plunger is forced to compress the spring by means of a pull 46 which extends through an aperture 48 in the top wall of the cover (see FIG. 11). The aperture 48 has a larger portion **48*a* and a smaller portion 48*b*. The larger portion 48*a* is sufficiently large to allow for passage of a spherical keeper 47 which is affixed to the pull shaft near the plunger. After the plunger has been operated to compress spring 44 in the manner shown in FIG. 10 with the spherical keeper having passed through the larger diameter portion 48*a* of aperture 48, the pull is positioned to place the spherical keeper over the smaller diameter portion 48*b* and the pulling force is released so that the keeper abuts the cover around the margin of 48*b* and holds the spring compressed. Because of the relative proportions involved, the plunger must be compressed into the cover to allow the cover to be swung to and from the closed position. Once the cover is in the closed position, the keeper is released to pass through 48*a*, with the spring urging the plunger downwardly aginst a stack of slides in the magazine. The pull 46 is flexible so that it does not restrict the swing of the cover to full open position (FIG. 9** in phantom).

The platform 38 on which the stack is supported is the top surface of the bottom member 50 of the device. A tongue 52 projects forwardly of the magazine and integrally joins to the sidewall of the magazine a small distance above the front edge of the platform 38 and member 50. The front edge of the platform and the front portion of the magazine sidewall cooperatively define a rectangular slot 54 whose length extends across the full width of the front portion of the magazine sidewall. The height of the slot is just large enough to allow for the passage of one slide through the slot. For the example described above as a two inch x two inch standard (opposed to glass mount) slide, the width of the slot 54 is just slightly greater than two inches, and the height of the slot is just slightly greater than 0.060 inches to allow for passage of a maximum thickness slide.

The device operates to push the lowest slide in the magazine along platform 38 and out the slot 54. As such, the slide being dispensed exits the slot in underlying relationshp to tongue 52. By inserting the tongue into a pocket 24 in the manner shown in FIG. 1, the tongue, in effect, opens the pocket and aligns slot 54 with the pocket opening such that the slide is pushed through the slot. Due to an extremely thin cross section of the tongue 52, the tongue occupies only a small volume of the pocket and allows the slide to readily pass into the pocket. After the slide has been inserted into the pocket, the device is pulled away, removing the tongue from the pocket, leaving the slide in stored position in the pocket. The operation of the device is such that the stroke of the member which pushes the slide out of the magazine is sufficient to fully lodge the slide into the pocket so that no further manipulation of the slide into the pocket need be performed after the device has been withdrawn from engagement with the pocket. Tongue 52 and magazine 32 are portions of a member 55.

Figure 9A:
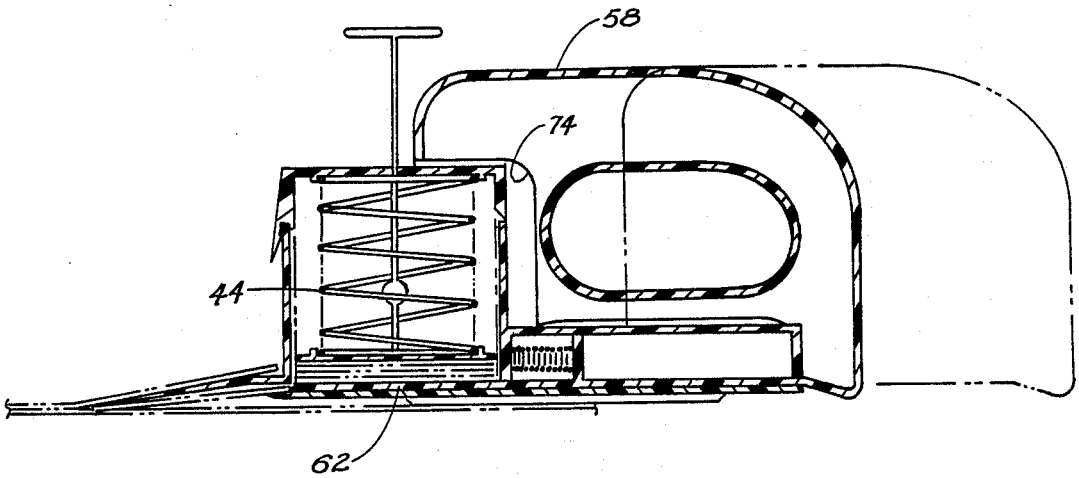
FIG. 9A is a view like FIG. 9, but illustrating an alternate position.
Figure 4:
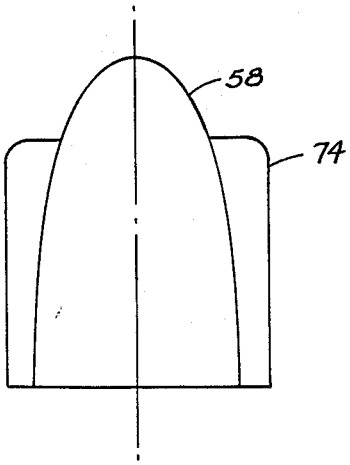
FIG. 4 is an elevational view as taken in the direction of arrows 4—4 in FIG. 3.

The member which pushes the slide out of the magazine is designated 56. This member 56 comprises a handle 58 which is used to grasp the device for inserting it into and removing it from a pocket, and which is pushed to eject a slide from the magazine. FIG. 9 shows the retracted position of the member 56, while FIG. 9A shows the extended position. In order to dispense a slide from the magazine after the tongue 52 has been inserted into a pocket, the member 56 is operated from the FIG. 9 position to the FIG. 9A position by grasping the handle and pushing forwardly toward the tongue.

Figure 15:
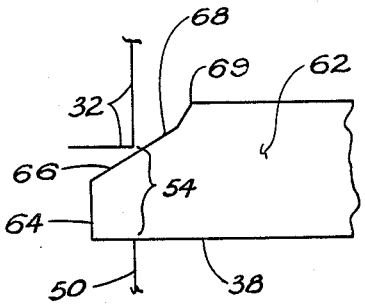
FIG. 15 is an enlarged view showing still more detail.
Figure 7:
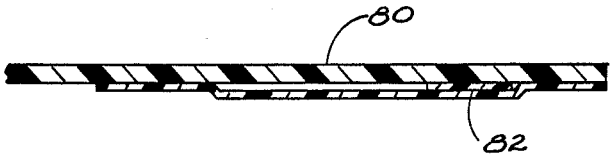
FIG. 7 is a fragmentary sectional view taken in the direction of arrows 7—7 in FIG. 4A.
Figure 8:
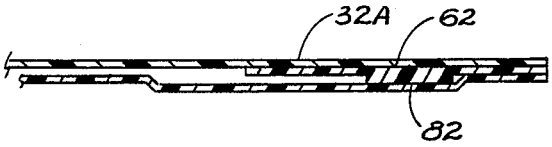
FIG. 8 is a fragmentary sectional view taken in the direction of arrows 8—8 in FIG. 4A.
Figure 14:
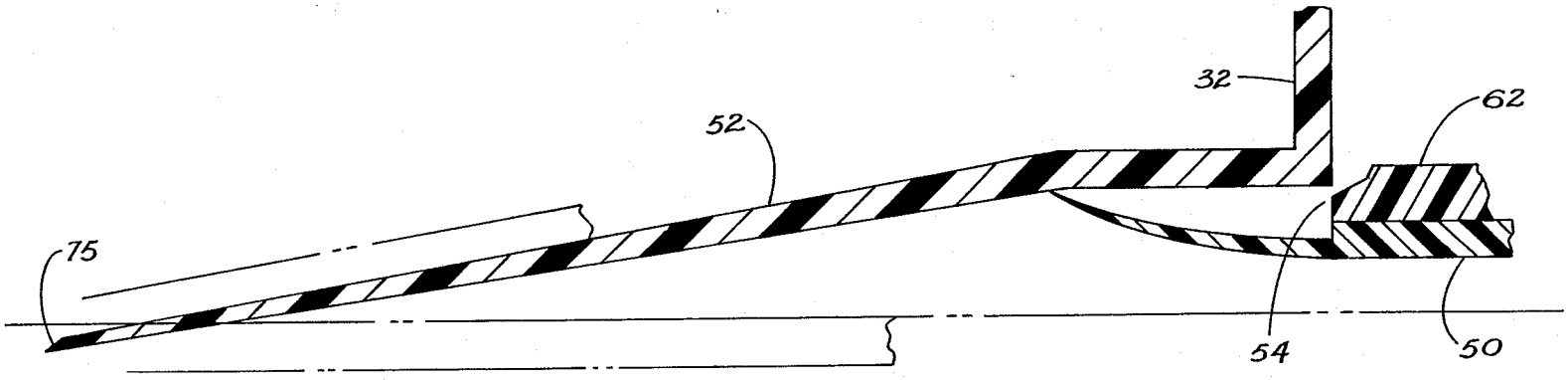
FIG. 14 is a further enlarged portion of FIG. 12 illustrating more detail.
Figures 14A, 14B, 14C:
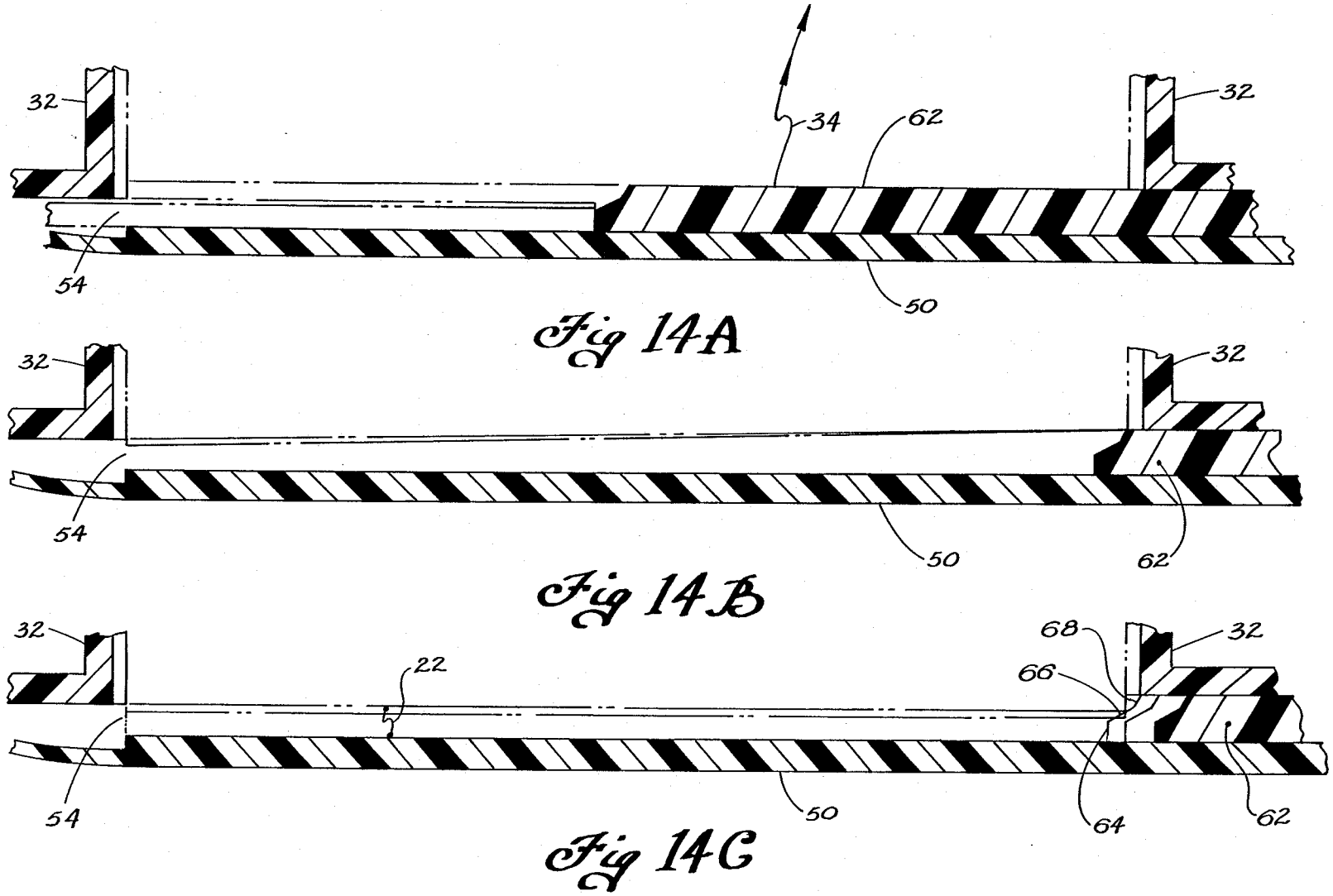
FIGS. 14A, 14B and 14C are enlarged views of other portions of FIG. 12 to illustrate further detail.

The rear of the sidewall of the magazine has a slot 60 which is cooperatively defined by the platform 38 and the sidewall. The slot 60 extends across the full width of the magazine and has a thickness which allows the pusher blade 62 to slide through. The pusher blade is another part of member 56 and has a leading edge uniquely configured to push the lowest slide in the stack along the platform for ejecting that slide from the magazine while supporting the remainder of the stack in the magazine. The profile of the pusher blade's leading edge is shown in detail in FIGS. 14A, B and C and FIG. 15. The leading edge comprises a first surface 64 which is perpendicular to the platform surface 38 for abutting the edge of the lowest slide. The height of this surface 64 is less than the thickness of the edge of the slide. From the surface, the leading edge has a second surface 66 which is inclined at an angle, preferably thirty degrees, to the surface of platform 38 and this second surface 66 leads into a third surface 68 which is inclined at a few degrees either side of sixty degrees to the surface of the platform with a slight curve 69 at the top. As the lowest slide in the stack is being pushed from the stack, the cooperative effect of the latter two surfaces 66, 68 serves to maintain the overlying slides in the stack, allowing the blade to slide beneath the stack as the lowest slide is being pushed out of the stack. Hence, the cooperative effect is that only the lowest slide is dispensed while the action of the device proceeds smoothly and without undue restriction. The pushing mechanism is spring-loaded at 70 so that as a slide is being pushed out of the stack, a spring force resists the pushing motion. It is important, however, that the force be sufficiently small not to damage the pocket into which the tongue is inserted or the slide being pushed because the force is reacted against the interior of the pocket by virtue of the insertion of the tongue into and the slide bottoming in the pocket. The spring 70 is housed in a spring retainer 32A, formed as a portion of member 55. One end of spring 70 bears against the magazine's rear sidewall just above slot 60 while its other end bears against an upright tab 73 of member 56.

Figure 4A:
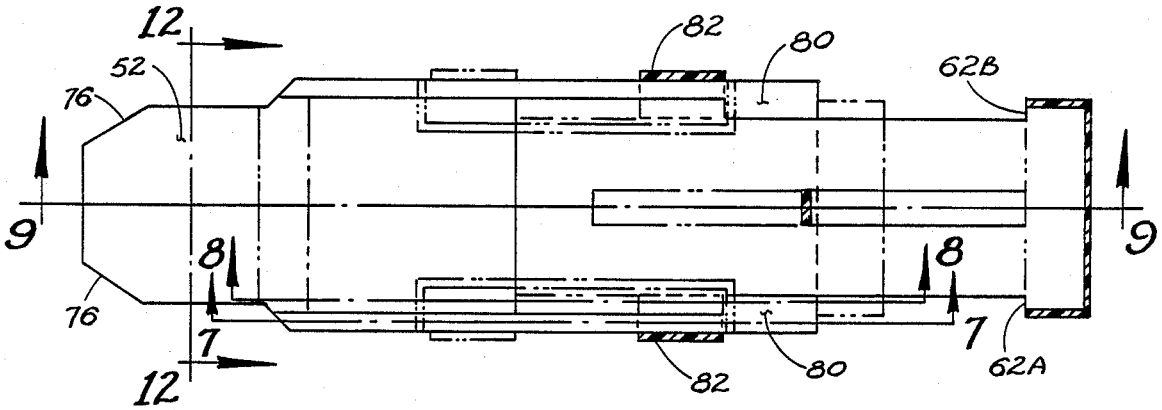
FIG. 4A is a plan sectional view taken in the direction of arrows 4A—4A in FIG. 3.
Figure 5:
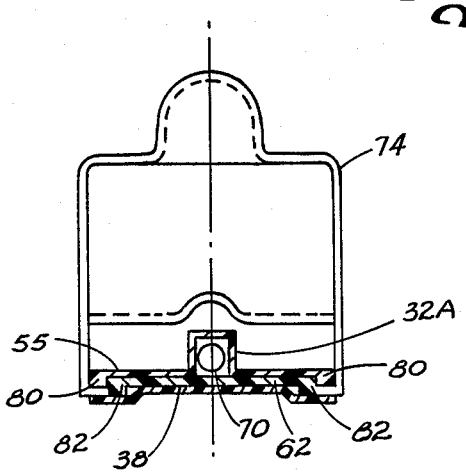
FIG. 5 is a sectional elevational view taken in the direction of arrows 5—5 in FIG. 3.
Figure 6:
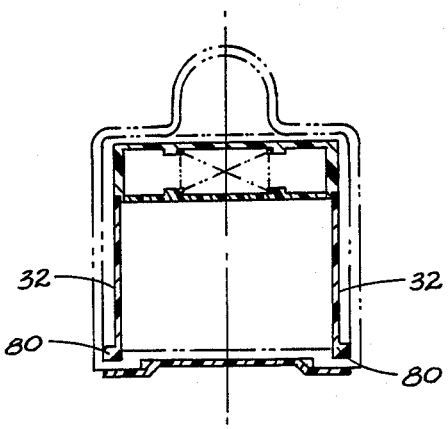
FIG. 6 is a sectional elevational view taken in the direction of arrows 6—6 in FIG. 3.

The member 56 is provided with a recess 74 at the forward portion of the handle to clear the rear portion of the magazine as the pusher comes to the fully extended position. The pusher travel is arrested by any suitable means, such as the tabs 62A and 62B at side rear of pusher 62 contacting the fixed rear ends of longitudinal guides 80 as shown at FIG. 4A. In this position the slide will have been pushed completely out of the magazine so that it is in the proper stored position in the pocket in which the tongue is inserted.

As the handle is moved away from tongue 52, the member 56 returns to the retracted position to allow the stack 34 to drop onto platform 38 as the blade 62 retracts out of the magazine. The device is pulled out of the pocket leaving the dispensed slide propery stored in the pocket. The device is ready to dispense the slide which is now lowest in the magazine.

The device enables slides to be quickly inserted into storage pockets by operation in the manner described, with the device being successively moved from pocket to pocket.

Figure 2:
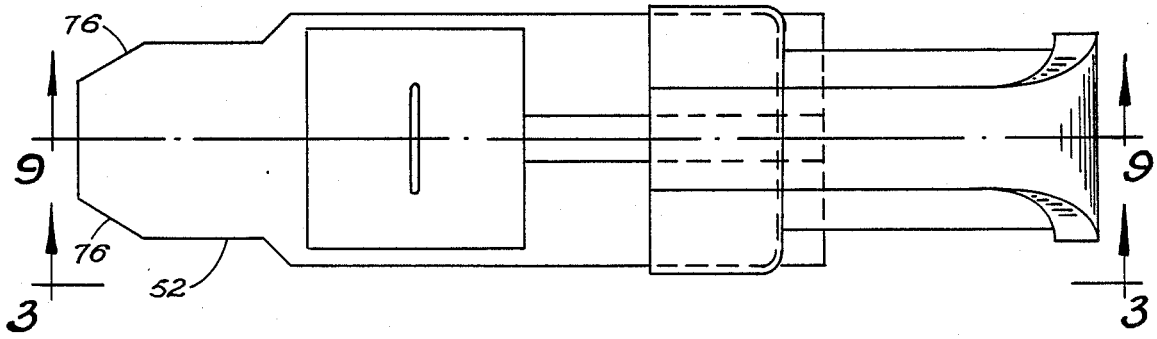
FIG. 2 is a top plan view of the device.
Figure 3:
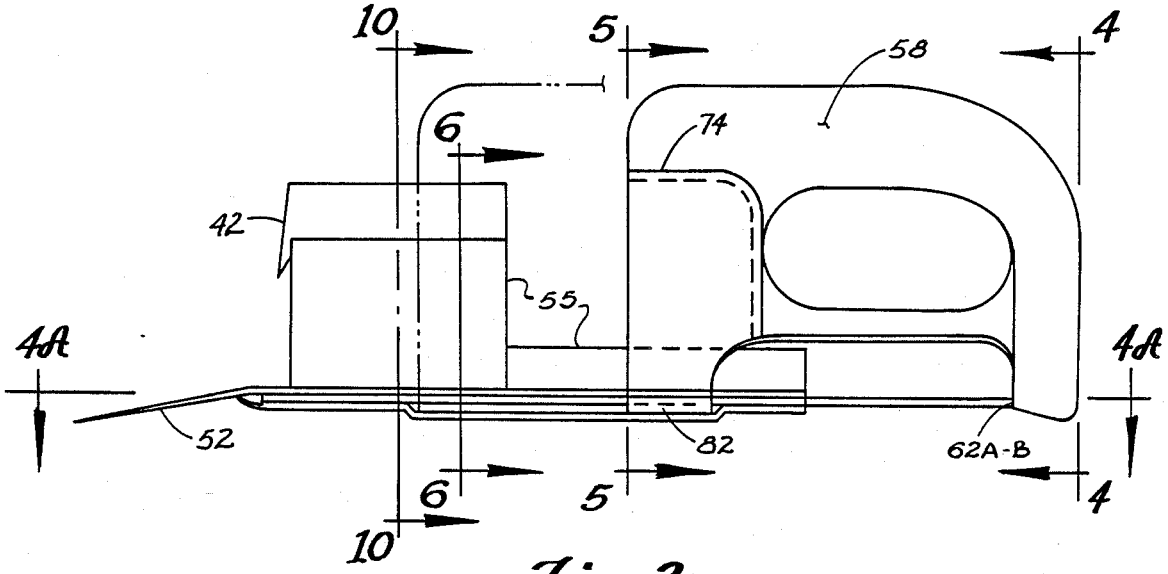
FIG. 3 is an elevational view of the device of FIG. 2 as taken in the direction of arrows 3—3 in FIG. 2.

The shape of the tongue facilitates the speed with which the device can be used and it aids in accurately guiding a slide being dispensed into a pocket. The tongue is tapered, and its lead edge 75 is beveled (see FIG. 14). The corners 76 are cut (see FIGS. 2 and 4A). The leading edge has a length which exceeds the film surface window of a mounted film transparency so as not to contact the film. On and one-eighth inch is a preferred dimension. The corners 76 are at obtuse angles of 109° to 120° to the leading edge 76, and merge into the longitudinal side edges of the tongue along curved radii, preferably of one and three-quarter inch radius. The 120° angle for the corners is preferred for the standard mounted transparencies while the 109° angle is preferred for glass slides. Hence, the tongue is well-suited for plying a pocket open and aligning the slot 54 with the pocket opening. As a slide is being dispensed, the slide will hit the tongue, tending to tip the slide downwardly into the pocket. Yet the tongue will resiliently flex slightly upwardly so as not to inhibit passage of the slide into the pocket. Accordingly, the tongue combines a certain stiffness for opening and engaging a pocket with a slight flexibility to allow deflection, as described, when a slide is being ejected.

Referring to FIG. 3 and 5 through 8, pads 82 are incorporated into the lower front corners of member 56. Guides 80 are formed in member 55 longitudinally along outer edges to each side of spring retainer 32A and related magazine 32. The pads 82 are shaped to fit onto the guides (FIG. 5) and are captured from below by the depressed side margins of bottom member 50. In this way the pads 82 travel along the guides 80 as the pusher extends and retracts relative to the other two members 50 and 55 which are joined together to capture the pusher member 56 between themselves. Thus, as the pusher blade travels forward it is guided by the spring retainer until entering the magazine, then by the lateral portions of the magazine sidewall until forward motion is complete. Details can be seen in FIGS. 5–6.

The particular construction of device 20 is efficient in use of materials thus can be fabricated and assembled in an economical fashion. Tongue 52, magazine 32, return spring retainer 32A and longitudinal guides 80 are part of the same member 55 which can be fabricated by molding techniques from suitable plastic material. The catch and hinge between the cover and sidewall of the magazine are integrally formed. The pusher blade 62, recess 74 and handle 58 are part of the same member 56 which is also fabricrated as a one piece member by plastic molding techniques. Due to required material thicknesses and tongue-to-storage-pocket relationships, the device may be tipped slightly upwardly at the rear so that the device is slightly inclined in relation to the pocket. A riser (not shown) could be incorporated into the bottom member to so incline the device when the device is at rest on a flat horizontal surface. Otherwise such inclination can be imparted by the manner in which the device is held when inserting slides into pockets.

It is to be appreciated that while the illustrated construction possesses numerous features, principles of the invention may be implemented in other embodiments. For example, it is contemplated that a device could be fabricated with multiple magazines and multiple tongues and pushers such that a number of slides could be inserted into a corresponding number of pockets in a single operation. Likewise, a device may be designed to handle slides other than the specific 35 mm example which has been described. Also, application of air cylinder actuation to pusher blade is a plausable alternative to the manually operated pushing mechanism.

Figure 16:
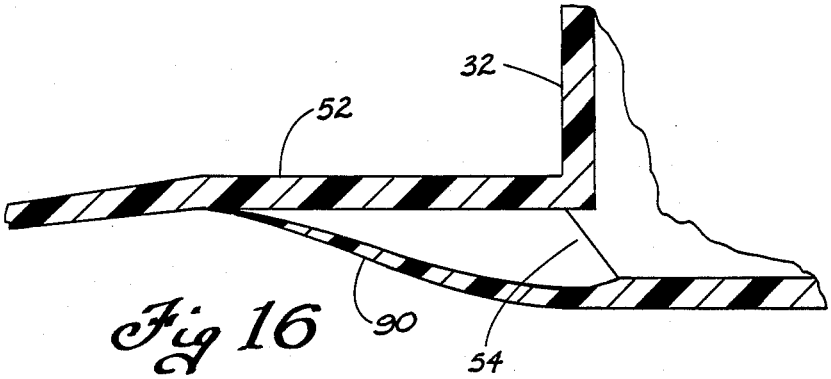
FIG. 16 is a fragmentary enlarged side elevational view of a portion of the device showing a modification.

FIG. 16 illustrates a modification which is especially useful for dispensing slides into storage pockets in which the edges at the top of a pocket's opening are congruent rather than offset. Pockets have such congruent edge openings occur along the top row of pockets in certain types of storage pocket pages.

The modification of FIG. 16 comprises the inclusion of an auxiliary tongue 90 that projects forwardly from the bottom edge of the exit slot 54 of the magazine in underlying relation to the overlying tongue 52. The auxiliary tongue need project forwardly only a sufficient distance to just enter the pocket when tongue 52 has been fully inserted into the pocket. The purpose of the auxiliary tongue is to prevent a dispensed slide from missing the pocket entrance by passing beneath the pocket instead of into it. The width of the auxiliary tongue may be equal to or less than that of tongue 52. The pusher need not necessarily travel as far as the contact point between the two tongues 52 and 90 when it is dispensing a slide.

Figure 17:
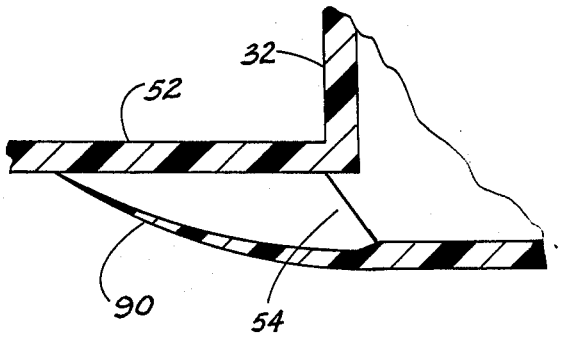
FIG. 17 is a fragmentary enlarged side elevational view of a portion of the device showing another form for the modification.

FIG. 16 shows one shape for the auxiliary tongue, while FIG. 17 shows a modified shape. Both shapes curve upwardly and forwardly terminating in tapered edges at their free ends. The tapered edge of the auxiliary tongue of FIG. 16 curves to a more or less tangent condition with tongue 52 while the tapered edge of the auxiliary tongue of FIG. 17 contacts tongue 52 at an acute angle as shown. Both auxiliary tongues are resiliently flexible so as to be filed out of the way by a slide that exits the magazine through slot 54. The tapered edge of the auxiliary tongue will ride against the slide until the slide has passed by, and it will then ride against the underside of the pusher member 56. After the pusher member has retracted, the resiliency of the auxiliary tongue will return it to the illustrated position.

Figure 19:
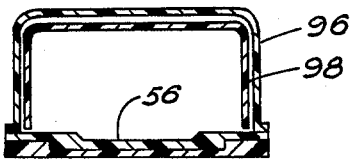
FIG. 19 is a transverse view in cross section as taken generally along arrows 19—19 in FIG. 18.
Figure 18:
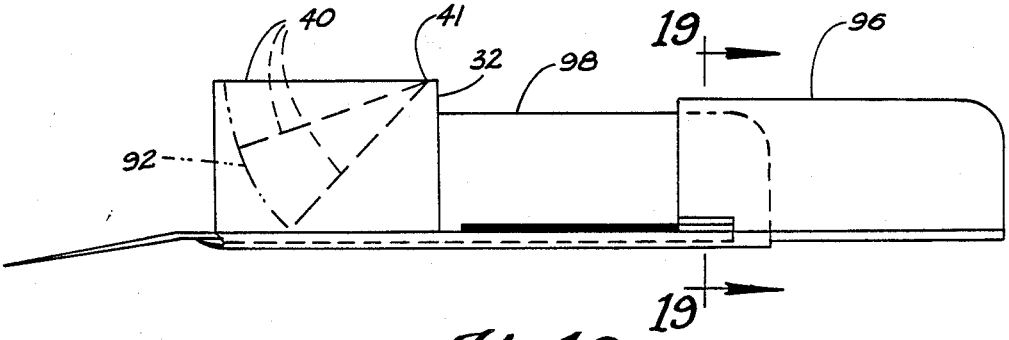
FIG. 18 is a side elevational view illustrating a modified embodiment of the device.

FIGS. 18 and 19 display another embodiment that differs in the following respects. The magazine 32 does not contain a spring-loaded plunger. Rather the magazine top cover contains a curved surface 92 that projects downwardly from the free edge of the cover opposite the line of hinge 41. The cover can be pushed downwardly into the magazine, as represented by broken lines in FIG. 18, causing the curved surface to forcefully bear against the top of an underlying stack of slides in the magazine. Such depression of the cover is accomplished manually, by finger or thumb. The top of the door can have a button, catch, pull, or some similar means to aid in its opening after it has been depressed into the magazine, or alternatively the device could be turned upside down to re-open the door by gravity.

The embodiment of FIGS. 18 and 19 is more vertically compact in that the handle for operating the pusher is a hollow box-like slide 96 that slides over a slightly smaller, but similarly shaped projection 98 that projects rearwardly of the magazine. The slide 96 is suitable for grasping and pushing forwardly over part 98 to dispense a slide. While this is being done, the top cover of the magazine is being depressed.

Figure 20:
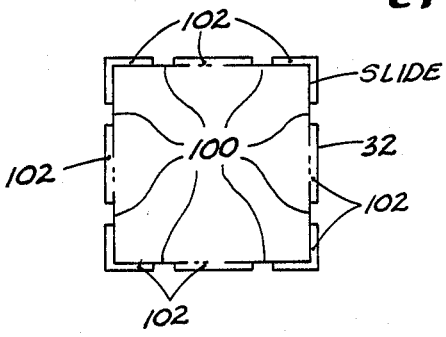
FIG. 20 is a transverse cross sectional view in the same general direction as FIG. 11.

If the sidewalls of the magazine are dimensioned too closely to the length and width of a slide, there may be a tendency to create a trapped air pocket beneath a slide, or slides, that could inhibit the displacement of a slide, or slides within the magazine. This can be avoided by making the opening somewhat larger than the area of a slide (FIG. 20) while incorporating integral vertical ribs 100 on the sidewalls of the magazine such that air escape passages 102 are provided between the ribs, and the ribs serve to define the area to be occupied by the stack of slides within the magazine.

Thus the embodiments of FIGS. 16–20 present further useful aspects of the invention.

What is claimed is:

1. A device for inserting picture slide transparencies into storage pockets which comprises:

a platform;

a magazine for a stack of transparencies on said platform such that the lowest transparency in the stack is on said platform, said magazine and platform cooperatively defining an exit slot which allows the lowest transparency in the stack to pass edgewise from the magazine into a storage pocket;

a pusher which overlies said platform and executes motion to push the lowest transparency in the stack in the magazine out through said exit slot and then retreat from under the stack;

and a tongue which projects away from the magazine in overlying relation to the exit slot for insertion into a storage pocket to open the storage pocket for reception of a slide which is pushed out of the magazine through said exit slot.

2. A device as set forth in claim 1 further including a spring-loaded plunger cooperatively associated with said magazine for lightly urging the stack of transparencies against said platform.

3. A device as set forth in claim 2 in which said magazine includes a cover which opens and closes the top of the magazine and said spring-loaded plunger is mounted in said cover.

4. A device as set forth in claim 3 including a keeper cooperatively associated with said spring-loaded plunger for holding said spring-loaded plunger in a retracted position within the cover so as to enable the cover to be operated from open to closed position with respect to the magazine.

5. A device as set forth in claim 1 including an entrance slot opposite said exit slot, and said pusher comprising a blade which enters said magazine through said entrance slot, pushes the lowest transparency in the magazine out through said exit slot, and then retracts out of the magazine via said entrance slot.

6. A device as set forth in claim 5 in which said blade is constructed and arranged to push only the lowest transparency in the stack out of the magazine through the exit slot while the blade supports the remainder of the stack as it pushes the lowest transparency in the stack out of the magazine whereby only the lowest transparency in the stack is dispensed from the magazine by the blade.

7. A device as set forth in claim 6 in which the leading edge of said blade comprises a first surface which is substantially perpendicular to the platform, said first surface being adapted for abutting the edge of the lowest transparency in the stack and the height of this first surface is less than the thickness of the edge of the lowest transparency in the stack, a second surface extends from the first surface at an inclined angle to the platform and this second surface leads into a third surface which is inclined at the greater degree to the platform.

8. A device as set forth in claim 7 in which said second surface is arranged at substantially 30 degrees to said platform and said third surface is arranged at about 60 degrees to said platform and including a curvature along the edge of said third surface which is opposite said second surface.

9. A device as set forth in claim 6 in which the width of said blade is just slightly less than the lateral dimension across said magazine whereby said magazine provides guidance for the travel of said blade through the magazine.

10. A device as set forth in claim 9 in which said pusher comprises stop tabs which project laterally beyond the width of the blade for limiting the stroke of the pusher.

11. A device as set forth in claim 5 in which said blade is part of a member which contains a handle which is operated to insert the tongue into a pocket, to dispense a transparency from the magazine into the pocket and to then withdraw the tongue from the pocket.

12. A device as set forth in claim 11 in which the pusher is spring-biased for return to a retracted position after having dispensed a transparency into a pocket.

13. A device as set forth in claim 12 in which said spring is housed on another member that also includes longitudinal guide means for guiding said pusher externally of said magazine.

14. A device as set forth in claim 13 in which said longitudinal guide means comprises lateral enlargements in a short local area to abut the ends of a depression in said pusher thus forming a travel stop for the dispensing and retracting motion of said pusher.

15. A device as set forth in claim 12 in which said handle is constructed and arranged to have a clearance pocket for the magazine which prevents interference of the handle with the magazine as the blade is pushing a slide out of the magazine through the exit slot.

16. A device as set forth in claim 1 in which said tongue has an inclined surface disposed in the path of a transparency exiting through said exit slot and said tongue is slightly deflectable.

17. A device as set forth in claim 16 in which said tongue is tapered at its distal end to facilitate insertion into a pocket.

18. A device as set forth in claim 17 in which said tongue is angled on longitudinal sides in a manner to provide a one and one-eighth inch leading edge, corners at obtuse angles between 109° and 120° to the leading edge on each side, with a radius of about one and three-quarter inches at the merger of the corners with the longitudinal edges of the tongue.

19. A device as set forth in claim 1 in which said tongue and magazine are a part of one member, said pusher is part of another member which also contains an operating handle for the device and including a third member which cooperates with said first and second-mentioned members such that the second-mentioned member is captured with respect to the first-mentioned member so as to enable the second-mentioned member to be displaced in the direction of travel of said pusher with respect to the first-mentioned member.

20. A device as set forth in claim 1 including a further tongue that projects away from the magazine in underlying relation to the exit slot and that is of a sufficient length to be inserted into a storage pocket when the first tongue is substantially fully inserted into a storage pocket, said further tongue serving to cooperate with said first tongue in ensuring that a dispensed slide does not miss the storage pocket into which the first tongue is inserted.

21. A device as set forth in claim 1 in which said magazine has internal ribs to define air spaces alongside a stack of slides disposed in the magazine.

22. A device as set forth in claim 1 in which said magazine includes a cover which opens and closes the top of the magazine, said cover being depressible into the magazine to exert a depressing force on a stack of slides disposed in the magazine.

23. A device for inserting picture slide transparencies into storage pockets comprising a pusher blade which passes through a magazine containing a stack of transparencies to push a transparency from the stack edgewise out of the magazine through an opening in the magazine, said blade comprising leading profile comprising a first surface for abutment with the edge of a transparency to be pushed out of the magazine, said first surface being generally normal to the direction of pushing and its height being less than the thickness of the edge of the transparency, a second surface extending from said first surface at an inclined angle to the direction of pushing, and a third surface extending from said second surface at an even greater inclination than said second surface, and said third surface merging into a fouth surface which is essentially parallel to the direction of pushing, said leading profile aiding in the separation of the transparency being pushed from the stack by having the fourth surface come into play in supporting the stack as the transparency being pushed is separated from the stack.

24. A device as set forth in claim 23 in which said second surface is inclined at about 30° and said third surface at about 60°, and the transition from said third surface to said fourth surface is slightly radiused.

25. A device as set forth in claim 23 in which used device includes a tongue which projects from the magazine in overlying relation to said opening to open a storage pocket for reception for a slide transparency, said tongue has an inclined surface disposed in the path of a transparency exiting said opening, said tongue is slightly deflatable and in which said tongue is angled on longitudinal sides in a manner to provide a one and one-eighth inch leading edge, corners at obtuse angles between 109° and 120° to the leading edge on each side, with a radius of about one and three-quarter inches at the merger of the corners with the longitudinal edges of the tongue.

* * * * *